United States Patent [19]

Cherry

[11] Patent Number: 4,882,518

[45] Date of Patent: Nov. 21, 1989

[54] BACK CAP FOR AN ELECTROLUMINESCENT DISPLAY

[75] Inventor: Walter L. Cherry, Waukegan, Ill.

[73] Assignee: The Cherry Corporation, Waukegan, Ill.

[21] Appl. No.: 198,233

[22] Filed: May 25, 1988

[51] Int. Cl.[4] ..... H05B 33/04

[52] U.S. Cl. ..... 313/512; 313/506; 428/425.8; 428/690

[58] Field of Search ..... 313/498, 506, 509, 512, 313/511; 428/550, 630, 650, 326, 425.1, 425.8, 464, 478.4, 478.8, 479.3, 479.6, 438, 690; 220/2.1 R, 2.2

[56] References Cited

U.S. PATENT DOCUMENTS

| | | | |
|---|---|---|---|
| 4,104,555 | 8/1978 | Fleming | 313/512 |
| 4,325,489 | 4/1982 | Russell et al. | 220/2.2 |
| 4,357,557 | 11/1982 | Inohara et al. | 313/512 X |

*Primary Examiner*—Kenneth Wieder

*Attorney, Agent, or Firm*—Willian Brinks Olds Hofer Gilson & Lione

[57] ABSTRACT

An electroluminescent display panel has a glass substrate which supports a matrix of electrodes and phosphor pixels. The matrix and a molecular sieve are vacuum sealed against the substrate within a compliant back cap made of laminated layers of aluminum and polyethylene.

39 Claims, 1 Drawing Sheet

FIG. 1
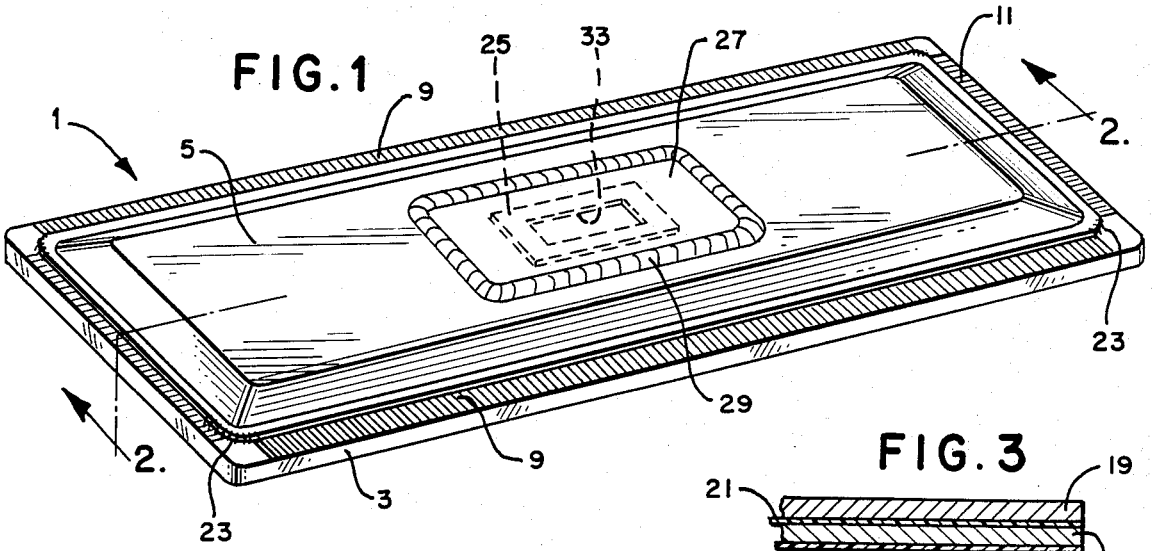
FIG. 3
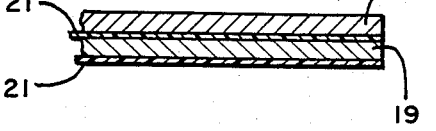
FIG. 2
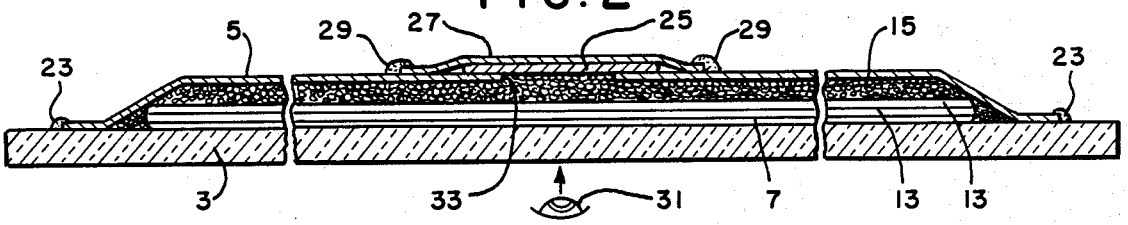
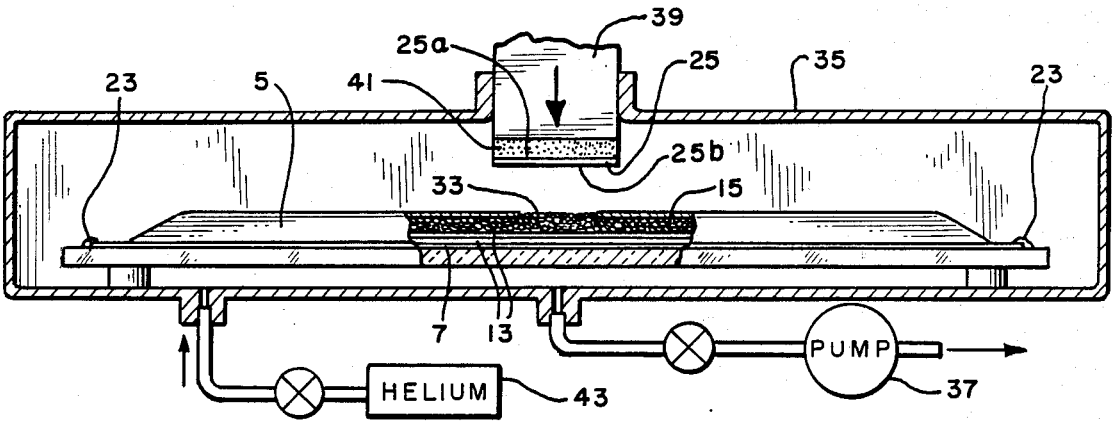
FIG. 4
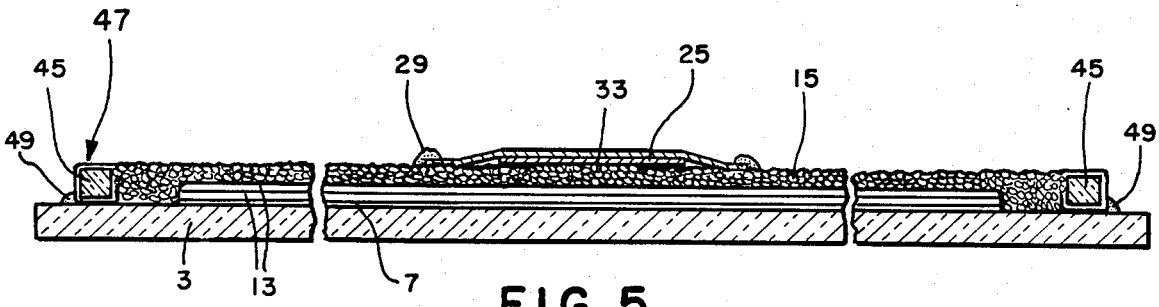
FIG. 5

BACK CAP FOR AN ELECTROLUMINESCENT DISPLAY

TECHNICAL FIELD

This invention relates to improved materials and an improved method for sealing the phosphor elements of an electroluminescent display. More particularly, the invention relates to an electroluminescent display which has a hermetically sealed back cap which is made of a compliant laminate of relatively thin plastic and aluminum layers.

BACKGROUND OF THE INVENTION

Electroluminescent displays have phosphor elements which emit light when they are electrically energized. Typically, electroluminescent displays have a glass substrate on which a layered structure of electrically conducting electrodes and phosphor is disposed. The phosphor emits light when an energization signal is applied to the electrodes of the display. The light emitted by the phosphor is observed through the glass substrate, which is the front screen of the display.

It has been found that the phosphor and electrode elements of the display can be covered by a back cap which may be made of metal or glass. The back cap encloses the phosphor and electrode elements and is adhered to the glass substrate, for example by epoxy. The space defined within the back cap can include a dessicant, such as alumino silicate beads which absorb water and thereby increase the life of the phosphor of the display.

If the interior of the sealed back cap includes air or gas under atmospheric pressure, for example 15 psi, the relatively rigid metal or glass material of the back cap is well-suited to provide a near hermetic seal if the external ambient pressure is similar to the pressure in the back cap. However, if the back cap is exposed to a relatively low ambient pressure, for example as would occur if the display is shipped by air in an unpressurized container, the pressure differential between the interior of the back cap and the surrounding air will cause the back cap, glass substrate or both of them to rupture and therefore break the hermetic seal. Exposure of the phosphor of the panel to ambient air and moisture will result in a rapid and severe degradation of the panel and loss of useful life for the display.

It would be possible to avoid rupturing the back cap and substrate by increasing the thickness of the material of these elements. However, the required thickness of material for pressure differentials encountered in air transportation would result in a panel which is undesirably heavy. Also, a sturdy metal back cap could expand and contract relative to the glass substrate in response to changes in ambient temperature and could therefore break the seal.

Moreover, if the internal pressure of the back cap is reduced significantly below ambient pressure, the back cap and substrate will tend to implode. Thus, a substantial pressure differential resulting from lower or higher external pressure can result in breaking of the hermetic seal and destruction of the panel.

It is desirable to provide a relatively light back cap which will hermetically seal the phosphor and electrode elements of an electroluminescent display, despite changes in ambient pressure.

Accordingly, the basic object of the invention is to produce a display with a compliant back cap which can be evacuated and which will not be affected by fluctuations of ambient air pressure.

A further object of the invention is to provide such an electroluminescent display with a back cap which is made of at least one compliant metal layer.

Another object of the invention is to provide such a compliant back cap which contains a dessicant in vacuum and which presses the dessicant against the phosphor of the display, so that ambient air pressure is equally maintained on the back cap and underlying phosphor.

A further object of the invention is to provide a method for making a compliant back cap of an electroluminescent display.

These and other objects of the invention will become apparent from a review of the drawings and the detailed description which follows.

SUMMARY OF THE INVENTION

In order to achieve the objects of the invention and to overcome the problems of the prior art, the electroluminescent display panel of the invention includes a back cap which is made of thin, compliant laminated layers of plastic and aluminum. The back cap seals phosphor elements of the display in a vacuum. The laminate of the back cap is sufficiently compliant to press a dessicant against the phosphor so that ambient air pressure is equally maintained on the back cap and substrate.

BRIEF DESCRIPTION OF THE DRAWINGS

FIG. 1 is a perspective view of an EL display panel.

FIG. 2 is a cross-sectional view of the panel of FIG. 1.

FIG. 3 is a cross-sectional view of a laminate for the back cap of the panel of FIGS. 1 and 2.

FIG. 4 is a cross-sectional view of an unsealed EL panel in association with a diagrammatically illustrated vacuum chamber.

FIG. 5 is a cross-sectional view of an alternative embodiment of an EL panel.

DETAILED DESCRIPTION

FIG. 1 illustrates a perspective view of the back of an EL display panel 1. The panel 1 has a transparent glass substrate 3 which supports a matrix of electrically conducting transparent electrodes and phosphor pixels which are enclosed and hermetically sealed against the substrate 3 by a back cap 5.

FIG. 2 illustrates a cross-sectional view of the display panel of FIG. 1, taken along a line 2—2 and viewed in the direction of the arrows. With reference to FIG. 2, the matrix 7 of transparent electrodes and phosphor pixels is shown diagrammatically as a single layer to facilitate an understanding of the panel. The matrix is formed of electrically conducting row electrodes which are disposed in one plane and electrically conducting column electrodes which are disposed in a second spaced parallel plane intersecting at right angles to the row electrodes. Phosphor pixels are disposed between the row and column electrodes at points of intersection of the electrodes. The phosphor pixels emit light in response to an energizing voltage which is applied across associated intersecting column and row electrodes. The image formed by the lighted pixels is viewed in the direction indicated at 31.

FIG. 1 illustrates the connector end portions of column electrodes 9 and row electrodes 11 which form the display matrix with phosphor pixels within the back cap 5. The phosphor may be approximately 1 mil (0.0254 mm) thick. The matrix and other components of the electroluminescent panel of FIGS. 1 and 2 are shown out of scale in order to facilitate an understanding of the structure of the panel.

With reference to FIG. 2, two layers 13 of porous paper sheets are disposed over the display matrix 7. Clean room wipes such as are commercially available from the Texwipe Company have been used to form the two sheets 13 which are each about 10 mil (0.254 mm) thick. A 13X molecular sieve 15 is disposed on top of the paper sheets 13. The molecular sieve 15 is preferably made of beads of dessicant which are about 40 mil (1.016 mm) in diameter.

FIG. 3 shows an expanded partial cross-sectional view of a compliant four ply laminate of the back cap 5 of FIGS. 1 and 2. The back cap is made of alternating layers of a metal 19, for example aluminum, and a plastic, for example polyethylene 21. The metal and plastic layers are laminated together, for example by heat sealing, in a known manner. As an example, the back cap may be made of two 5 mil (0.127 mm) layers of aluminum and two 2 mil (0.0508 mm) layers of plastic, as shown in FIG. 3.

With reference to FIG. 2, the compliant back cap 5 is adhered against the substrate 3 by cement, for example epoxy, to form a seal 23 which has a relatively low diffusion rate for water and gases. A vacuum is sealed within the back cap 5 by an adhesive patch 25 and an overlying laminate patch 27 which is made of the same material as the back cap. The outer patch 27 is adhered and sealed at 29 to the back cap by a cement, for example epoxy.

In operation of the EL panel of FIG. 2, the molecular sieve 15 absorbs any residual moisture within the back cap after a vacuum is applied and sealed therein. The vacuum within the back cap causes the laminate to flex tightly against the molecular sieve 15 and thereby press the molecular sieve against the paper 13 and underlying phosphor of the matrix 7. The paper 13 cushions and distributes the force of the molecular sieve 15 so that a relatively uniform pressure is applied to the phosphor pixels of the matrix 7. The uniform pressure against the phosphor tends to cause the phosphor to light with increased intensity in response to electrical signals applied to the matrix. A D.C. EL display having the structure of FIGS. 1–3 has been found to have a significantly increased operational life, in part because moisture is effectively eliminated from within the back cap and thus does not degrade the phosphor. However, the compliant back cap structure could be used for other types of displays, such as AC EL displays.

An EL panel with the structure of FIGS. 1–3 is preferably manufactured in accordance with a process which will hereafter be described with respect to FIG. 4. In an initial phase of this process the phosphor and electrode matrix 7 may be manufactured in a manner which is described in the U.S. patent application Ser. No. 24,982, filed Mar. 12. 1987, and entitled "Electroluminescent Display With Interlayer For Improved Forming." This application is commonly owned and is incorporated herein by reference to provide background manufacturing information for a D.C. EL panel.

The laminate of the back cap is shaped by a known pneumatic forming process. However, the back cap could be formed in any known manner.

After the back cap is made and the EL matrix is formed on the surface of the substrate 3, the sheets 13 are placed on top of the matrix. Thereafter, with reference to FIG. 4, the back cap 5 is placed on the substrate 3 over the matrix 7 and paper 13. Epoxy is then applied at 23 around the periphery of the back cap to seal the back cap against the substrate.

As shown in FIGS. 1 and 4, the back cap 5 has a rectangular opening 33 which is cut through its top surface before the back cap is adhered to the substrate. After the epoxy seal 23 has cured, molecular sieve is poured through the opening 33 and into the back cap. The panel is then placed on a spin fixture which spins the panel until the molecular sieve is well-settled and is uniformly distributed in the back cap.

After the spinning operation, the panel is placed in a vacuum chamber 35, as shown at FIG. 4. A pump 37 pumps air from the chamber and thereby applies a vacuum within the chamber in order to remove moisture and contaminants from the interior of the back cap. A vacuum of about $10^{-2}$ mm of Hg has been found effective. Thereafter, a plunger 39 is pressed into the chamber to apply the adhesive patch 25 over the opening 33. The patch 25 may be made from a metalized tape which is manufactured by the 3M Company.

As shown in FIG. 4, the plunger 39 carries a foam pad 41 which is adhered to the top surface **25*a* of the patch 25 by a relatively weak tacky adhesive. The opposite side 25*b* of the patch 25 carries a relatively strong adhesive which adheres to the outer metal surface of the back cap 5 when the plunger is pressed against the back cap. The foam layer 41 of the plunger allows the adhesive patch 25 to be gently pressed against the surface of the back cap so that it adheres in sealing engagement with the back cap over the opening 33. When the plunger is backed away from the back cap, the weak adhesive at the top surface of the patch 25 tears away from the surface of he foam pad 41 so that the patch 25 remains adhered over the opening 33** and seals a vacuum within the back cap.

Thereafter, a helium tank 43 releases helium into the vacuum chamber until there is about 15 psi of helium within the chamber. The pressure differential between the helium and the vacuum within the back cap causes the compliant back cap 5 to collapse slightly and to press tightly against the molecular sieve 15. Also, the helium causes the patch 25 to firmly seat against the back cap. Helium is used to achieve final sealing of the patch 25, in order to ensure that air and moisture do not enter the back cap. After the patch 25 is sealed, the helium is evacuated from the vacuum chamber and the EL panel is removed from the chamber.

The outer patch 27 which is made of the laminate material of FIG. 3 is then sealed over the adhesive patch 25 by the epoxy seal 29 in order to ensure that no air or moisture will enter the back cap through the patch 25. The outer patch 27 is oriented so that its metal side is adhered to the metal side of the back cap.

Although particular materials and a particular process have been described with respect to FIGS. 1–4, it should be understood that other materials and processes can be employed without departing from the invention. Thus, for example, the back cap 5 could be made of a single compliant metal layer or a two-ply structure of metal and plastic. A four-ply structure is preferred, because the two layers of metal, for example aluminum, in that structure will likely provide a reliable hermetic seal, even if the metal layers have pinhole punctures.

However, a single layer of metal could be employed to provide an acceptable seal, if pinhole punctures in the metal are avoided in manufacturing. Also, more than four layers of metal and plastic could be employed to further increase the reliability of the hermetic seal of the back cap.

Other metals and plastics could be employed to make the back cap. Also, compliant materials other than metal might be suitable to provide a hermetic seal if they are substantially impermeable to gas. Moreover. molecular sieves having different sizes of beads could be used to provide an acceptable dessicant for the back cap. Also, the dessicant could be made of powder rather than beads and could be disposed in bags made of, for example, the paper which is used for the sheets 13. In this case, the material of the paper bags would serve the purpose of the paper layers 13. Alternatively, the molecular sieve could be formed in the shape of a cake which would be disposed within the back cap. Also, the material of the paper 13 could be changed. For example, a chemically inert, substantially pure cellulose, such as a laboratory filter paper, could be used to provide the cushioning function of the layers 13. Also, various types of commercially available materials and adhesives could be used for the patch 25.

Although a plunger is used to press the adhesive patch 25 against the back cap, other apparatus could be employed to provide a similar function. For example, the patch 25 could be affixed in manufacturing by use of a magnet. In operation, one side of the patch 25 would initially be adhered adjacent to the opening 33, and the other side would be held open by a metallic cross bar or pin disposed across the opening 33. After a vacuum is pumped in the vacuum chamber 35, the pin would be removed by magnetic attraction and would be manipulated by the magnet to press the patch 25 against the back cap and thereby seal the opening 33.

Also, it might not be necessary to adhere the outer patch 27 over the adhesive patch 25. The outer patch is presently used in order to ensure a hermetic seal and a long life for the panel. If less reliability is acceptable, the adhesive patch 25 might be sufficient to seal the opening 33. Alternatively, a single laminate seal could be adhered over the opening 33.

FIG. 5 illustrates an alternative embodiment of the EL panel wherein a rectangular glass frame 45 supports a relatively thin laminate 47 made of, for example, a four-ply structure of 2 mil (0.0508 mm) aluminum layers and 1 mil (0.0254 mm) polyethylene layers. As shown in FIG. 5, the relatively thin laminate 47 is wrapped around the frame 45 and the frame and laminate are adhered to the substrate by epoxy 49. When a vacuum is applied within the back cap of FIG. 5, the relatively thin compliant laminate 47 is tightly pressed against the underlying molecular sieve by atmospheric pressure so that the laminate conforms to the surface of the molecular sieve.

The hermetically sealed back caps of the EL panels of FIGS. 1–5 do not expand or contract in response to substantial changes in ambient pressure, because the vacuum contained within the back caps causes the compliant laminate to press against the dessicant and the dessicant to press against the phosphor in response to any reasonably expected ambient pressure. Accordingly, EL panels can be transported without pressure damage in the relatively low ambient pressure conditions which occur in air transportation. The panels also operate reliably at high altitude locations which have a low ambient pressure. The back cap maintains the required hermetic seal and therefore ensures that the EL panel will have a relatively long and stable operational life.

Although preferred materials and manufacturing process steps have been described, the scope of the invention is not limited by this particular description. The metes and bounds of the invention are determined by the following claims and by the equivalents covered by these claims.

I claim:

1. A display panel, comprising:

electroluminescent phosphor means for emitting light in response to electrical energization signals;

transparent substrate means for supporting said phosphor means and transmitting said emitted light;

back cap means for enclosing said phosphor means, said back cap means being made of a compliant substantially gas impermeable material for flexing without rupturing;

means for hermetically sealing said back cap means against said substrate means; and means for maintaining said back cap means in a flexed relation to said substrate means, so that varying ambient air pressure is equally applied to the back cap means and the substrate means without affecting the hermetic seal.

2. The display panel of claim 1, wherein said means for maintaining includes dessicant means disposed within said back cap means and over said phosphor means for absorbing moisture and pressing against said phosphor means in response to flexing of the compliant back cap means.

3. The display panel of claim 2, wherein said dessicant means includes a molecular sieve.

4. The display panel of claim 3, wherein said molecular sieve includes a plurality of beads of dessicant.

5. The display panel of claim 2, wherein said dessicant means includes a 13X molecular sieve.

6. The display panel of claim 2, further including load distribution means disposed between said dessicant means and said phosphor means for evenly distributing the load of said dessicant means over said phosphor means.

7. The display panel of claim 6, wherein said load distribution means includes at least one sheet of a clean room wipe.

8. The display panel of claim 6, wherein said load distribution means includes at least one sheet of cellulose filter paper.

9. The display panel of claim 1, wherein said back cap means is made of a compliant laminated four ply material having a first layer of metal, a second layer of plastic, a third layer of metal and a fourth layer of plastic.

10. The display panel of claim 1, wherein said back cap means is made of a compliant laminated four ply material having a first layer of aluminum, a second layer of polyethylene, a third layer of aluminum and a fourth layer of polyethylene.

11. The display panel of claim 1, wherein said material of said back cap means includes at least one compliant sheet of metal.

12. The display panel of claim 1, wherein said material of said back cap means includes at least one compliant layer of a metal and a laminated compliant layer of plastic.

13. The display panel of claim 12, wherein said metal layer is 5 mil (0.127 mm) thick and said plastic layer is 2 mil (0.0508 mm) thick.

14. The display panel of claim 1, wherein said back cap means is made of a laminated four ply material having a first aluminum layer 5 mil (0.127 mm) thick, a second polyethylene layer 2 mil (0.0508 mm) thick, a third aluminum layer 5 mil (0.127 mm) thick and a fourth polyethylene layer 2 mil (0.0508 mm) thick.

15. The display panel of claim 1, further including a frame for supporting said back cap means in sealed relationship against said substrate means.

16. The display panel of claim 15, wherein said frame is made of glass.

17. The display panel of claim 15, wherein the material of said back cap means is wrapped over said frame to form the top of the back cap means and is wrapped under the bottom edge of the frame for hermetic sealing against said substrate means.

18. A display panel, comprising electroluminescent phosphor means for emitting light in response to electrical energization signals;

transparent substrate means for supporting said phosphor means and transmitting said emitted light;

dessicant means disposed over said phosphor means for absorbing moisture;

back cap means for enclosing said dessicant means and said phosphor means in a vacuum against said substrate means; and means for hermetically sealing said back cap means against said substrate means;

said back cap means having compliant laminated metal and plastic layers for pressing said dessicant means against said phosphor means and maintaining the integrity of said hermetic seal despite variations in ambient pressure.

19. The display panel of claim 18, wherein said dessicant means includes a molecular sieve.

20. The display panel of claim 19, wherein said molecular sieve includes a plurality of beads of dessicant.

21. The display panel of claim 18, wherein said dessicant means includes a 13X molecular sieve.

22. The display panel of claim 18, further including load distribution means disposed between said dessicant means and said phosphor means for evenly distributing the load of said dessicant means over said phosphor means.

23. The display panel of claim 22, wherein said load distribution means includes at least one sheet of a clean room wipe.

24. The display panel of claim 22, wherein said load distribution means includes at least one sheet of cellulose filter paper.

25. The display panel of claim 18, wherein said back cap means is made of a compliant laminated four ply material having a first layer of metal, a second layer of plastic, a third layer of metal and a fourth layer of plastic.

26. The display panel of claim 18, wherein said metal layer is aluminum and said plastic layer is polyethylene.

27. The display panel of claim 18, wherein said back cap means is made of a laminated four ply material having a first layer of aluminum, a second layer of polyethylene, a third layer of aluminum and a fourth layer of polyethylene.

28. The display panel of claim 18, wherein said metal layer is 5 mil (0.127 mm) thick and said plastic layer is 2 mil (0.0508 mm) thick.

29. The display panel of claim 18, wherein said back cap means is made of a laminated four ply material having a first aluminum layer 5 mil (0.127 mm) thick, a second polyethylene layer 2 mil (0.0508 mm) thick, a third aluminum layer 5 mil (0.127 mm) thick and a fourth polyethylene layer 2 mil (0.0508 mm) thick.

30. The display panel of claim 18, further including a frame for supporting said back cap means in sealed relationship against said substrate means.

31. The display panel of claim 30, wherein said frame is made of glass.

32. The display panel of claim 30, wherein the material of said back cap means is wrapped over said frame to form the top of the back cap means and is wrapped under the bottom edge of the frame for hermetic sealing against said substrate means.

33. A display panel, comprising:

electroluminescent phosphor means for emitting light in response to electrical energization signals;

transparent substrate means for supporting said phosphor means and transmitting said emitted light;

a molecular sieve disposed over said phosphor means for absorbing moisture;

at least one layer of paper disposed between said molecular sieve and said phosphor means for evenly distributing the load of said molecular sieve against said phosphor means;

back cap means for enclosing said molecular sieve, paper and said phosphor means in a vacuum against said substrate means; and means for hermetically sealing said back cap means against said substrate means;

said back cap means being made of a compliant laminated four ply material of alternating metal and plastic layers for pressing said molecular sieve against said paper and said phosphor means and maintaining the integrity of said hermetic seal despite variations in ambient pressure.

34. A method for manufacturing an electroluminescent panel having a glass substrate supporting a matrix of conducting electrodes and phosphor, at least one layer of paper, a molecular sieve and a back cap made of compliant laminated layers of metal and plastic, the method comprising the steps of:

placing at least one layer of paper over the phosphor matrix of the substrate;

forming an opening through the top of said back cap;

sealing the base of the back cap to the substrate with epoxy so that the back cap encloses the phosphor matrix and layer of paper;

pouring molecular sieve through said opening until the back cap is filled with molecular sieve;

agitating the substrate and back cap until the sieve is evenly packed within the back cap;

pumping a vacuum within the back cap until substantially all water is removed; and sealing the opening in the back cap so that a vacuum is maintained within the back cap and the compliant back cap presses the molecular sieve and underlying paper against the phosphor matrix when the panel is exposed to ambient air.

35. The method of claim 34, wherein the step of sealing the opening includes the further step of sealing the opening with a patch of adhesive metal tape.

36. The method of claim 34, wherein the step of sealing the opening includes the further step of using a plunger to press a patch of adhesive metal tape over the opening while maintaining a vacuum around the panel.

37. The method of claim 34, wherein the step of sealing the opening includes the further steps of pressing a patch of adhesive metal tape over the opening while maintaining a vacuum around the panel;

applying an inert gas at atmospheric pressure around the panel until the metal tape is fully sealed over the opening;

removing the inert gas; and exposing the panel to ambient air.

38. The method of claim 37, wherein said step of applying an inert gas includes the step of applying helium gas.

39. The method claim 37, further including the step of placing a patch made of the laminated material of the back cap over the patch of metal tape and sealing the laminated patch to the back cap.

* * * * *

UNITED STATES PATENT AND TRADEMARK OFFICE

CERTIFICATE OF CORRECTION

PATENT NO. : 4,882,518

DATED : November 21, 1989

INVENTOR(S) : Walter L. Cherry

It is certified that error appears in the above-identified patent and that said Letters Patent is hereby corrected as shown below:

In column 4, line 38, please delete "he" and substitute therefor --the--.

In column 5, line 10, after "Moreover" please delete --.-- and substitute therefor --,--.

Column 7, line 20:

In claim 18, line 1, after "comprising" please insert --:--.

Signed and Sealed this

Twenty-fifth Day of August, 1992

*Attest:*

DOUGLAS B. COMER

*Attesting Officer*

*Acting Commissioner of Patents and Trademarks*